US009574338B1

(12) United States Patent
Cannon

(10) Patent No.: US 9,574,338 B1
(45) Date of Patent: Feb. 21, 2017

(54) SUMP PIT SAFETY SHIELD

(71) Applicant: Jesse C. Cannon, Littleton, CO (US)

(72) Inventor: Jesse C. Cannon, Littleton, CO (US)

( * ) Notice: Subject to any disclaimer, the term of this patent is extended or adjusted under 35 U.S.C. 154(b) by 0 days.

(21) Appl. No.: 14/832,958

(22) Filed: Aug. 21, 2015

(51) Int. Cl.
*E03F 5/22* (2006.01)

(52) U.S. Cl.
CPC ..... *E03F 5/22* (2013.01)

(58) Field of Classification Search
CPC ..... E03F 5/22; E02D 29/127; E02D 29/14; E02D 29/1427; E02D 29/1481; E02D 29/1409; E04F 17/06; B65D 43/0214; B65D 43/0202; B65D 43/02
USPC ..... 52/19, 20, 21, 107, 169.6, 169.7; 220/287, 323, 315, 567.1
See application file for complete search history.

(56) References Cited

U.S. PATENT DOCUMENTS 948,539 A * 2/1910 Clark ..... B28B 7/168 249/11
2,057,866 A 10/1936 Weber
2,530,911 A 11/1950 Schultz
3,010,598 A * 11/1961 Foss ..... B65D 81/3211 206/222
3,699,730 A 10/1972 Humphrey
3,969,847 A 7/1976 Campagna et al.
4,080,984 A 3/1978 Klein
4,530,443 A * 7/1985 Gorges ..... F16B 37/044 220/327
4,712,329 A 12/1987 Anderson
4,726,490 A 2/1988 Bonnema et al.
4,902,165 A 2/1990 Embree
5,105,966 A * 4/1992 Fort ..... F16J 13/00 220/327
5,271,518 A * 12/1993 Webb ..... F15B 1/26 220/320
5,290,006 A * 3/1994 Gouker ..... E02D 29/12 249/146
5,297,895 A * 3/1994 Johnson ..... E02B 11/00 405/37
5,324,135 A 6/1994 Smith
5,513,770 A 5/1996 Seeley et al.
5,816,510 A * 10/1998 Earle, III ..... E03F 5/22 241/285.1
5,845,442 A 12/1998 Strehlow
5,950,860 A * 9/1999 Kesterman ..... B67D 7/3209 220/324
6,161,985 A * 12/2000 Hinkle ..... E02D 29/1409 249/2
6,189,717 B1 * 2/2001 Versaw, Jr. ..... E02D 29/12 220/565

(Continued)

FOREIGN PATENT DOCUMENTS

WO WO 2005093168 A1 * 10/2005 ..... E02D 29/12

*Primary Examiner* — Joshua J Michener
*Assistant Examiner* — Alp Akbasli
(74) *Attorney, Agent, or Firm* — Ramon L. Pizarro; Edwin H. Crabtree

(57) ABSTRACT

A safety barrier for a sump pit is disclosed. The safety barrier cooperates corrugations or discontinuities in the sump pit to support the safety barrier within the sump pit. The safety barrier includes a planar platform and at least two extendible legs that are attached to the planar platform. The extendable legs are used to contact or engage corrugations or discontinuities in the sump pit. The extension of extendable legs from the planar platform traps the device within the recessed surface of one of the corrugations or discontinuities of the sump pit.

2 Claims, 3 Drawing Sheets

(56) References Cited

U.S. PATENT DOCUMENTS

| | | | | |
|---|---|---|---|---|
| 6,920,998 | B2 | 7/2005 | Diamond | |
| 7,607,858 | B1 * | 10/2009 | Mosholder | E02D 29/1427 404/25 |
| 7,744,305 | B2 | 6/2010 | Choi | |
| 7,870,867 | B2 | 1/2011 | Agbay | |
| 7,966,786 | B2 * | 6/2011 | Koteskey | E02D 29/12 220/4.04 |
| 7,997,031 | B2 * | 8/2011 | Meyers | E02D 29/12 404/25 |
| 8,858,114 | B2 * | 10/2014 | Gaspar | E02D 29/12 404/25 |
| D725,739 | S * | 3/2015 | White | B01D 29/68 D23/206 |
| 2003/0136789 | A1 * | 7/2003 | Bolzer | B65D 88/06 220/567.1 |
| 2009/0324328 | A1 | 12/2009 | Roberts | |
| 2010/0178106 | A1 * | 7/2010 | Mitchell | E02D 29/1445 404/26 |
| 2013/0118960 | A1 * | 5/2013 | Tandon | B04C 5/28 210/95 |

* cited by examiner

SUMP PIT SAFETY SHIELD

BACKGROUND OF THE INVENTION (a) Field of the Invention

This application relates to a device and system for preventing people, and particularly children, from falling into plumbing or drainage pits, and particularly access pits that are lined with corrugated pipe, such as metal or HDPE plastic type pipe.

(b) Discussion of Known Art

Sump pumps are typically housed within sump pits in the manner show in U.S. Pat. No. 8,500,412 to Williams et al., incorporated herein by reference in its entirety. As can be appreciated by the installation shown in the Williams et al. disclosure, many systems and connections used to operate the sump pump. These systems and connections extend into the sump pit, which is typically made from corrugated plastic material, such as HDPE (high density polyethylene). The sump pit is typically installed with a lid that has one or more cutouts that allow tubing and electrical systems that are connected to the pump to extend from the pit.

An important problem associated with these pump pit and lid arrangements is that the lid is often easily removed. This is particularly true of systems made from corrugated plastic, where the lid is also made of plastic, and thus any mechanisms used to secure the lid to the pit are also plastic. The drawback to these lids is that the rigidity and strength of the lids facilitates easy removal by children, and do not resist a great amount weight. Thus, there exists a danger of unintended removal of the lid, or of re-installing of the lid in a manner that the lid cannot resist the weight of a child, much less the weight of an adult.

Accordingly, there remains a need for a device that acts as a backup safety mechanism that limits the possibility of people stepping into the pit, either because the lid was left off of the pit or because the lid was improperly engaged and the weight of the person allow the person to fall into the pit.

Therefore, a review of known devices reveals that there remains a need for a simple device that can be used to reduce the risk of stepping into a sump pit. Still further, there remains a need for a simple device that serves as a second tier of protection in preventing children from falling into sump pits, and for reducing the possibility of injury to an adult who inadvertently steps into the sump pit.

Still further, there remains a need for a safety device that is easy to install within a sump pit, and which impedes falls into the sump pit while accommodating space for the routing of tubing and electrical systems that are used with the sump pump.

SUMMARY

It has been discovered that the problems left unanswered by known art can be solved by providing a barrier that mounts inside a sump pit and includes:

a generally planar platform; and at least two extendible legs that are attached to the planar platform, the extendable legs extending along a direction that is generally parallel to the platform. The arrangement allows the user to position the platform against a concave portion of one of the corrugations of the sump pit.

According to a preferred embodiment of the invention, the device includes two adjacent legs that are fixed and two adjacent legs that are extendable. The non-extendible legs fit into the concave portion of the corrugations, and the extendible legs are used to engage opposing concave surface of the corrugations.

It will be understood that the disclosed invention provides additional protection and will not interfere with the systems used in connection with the sump pump.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
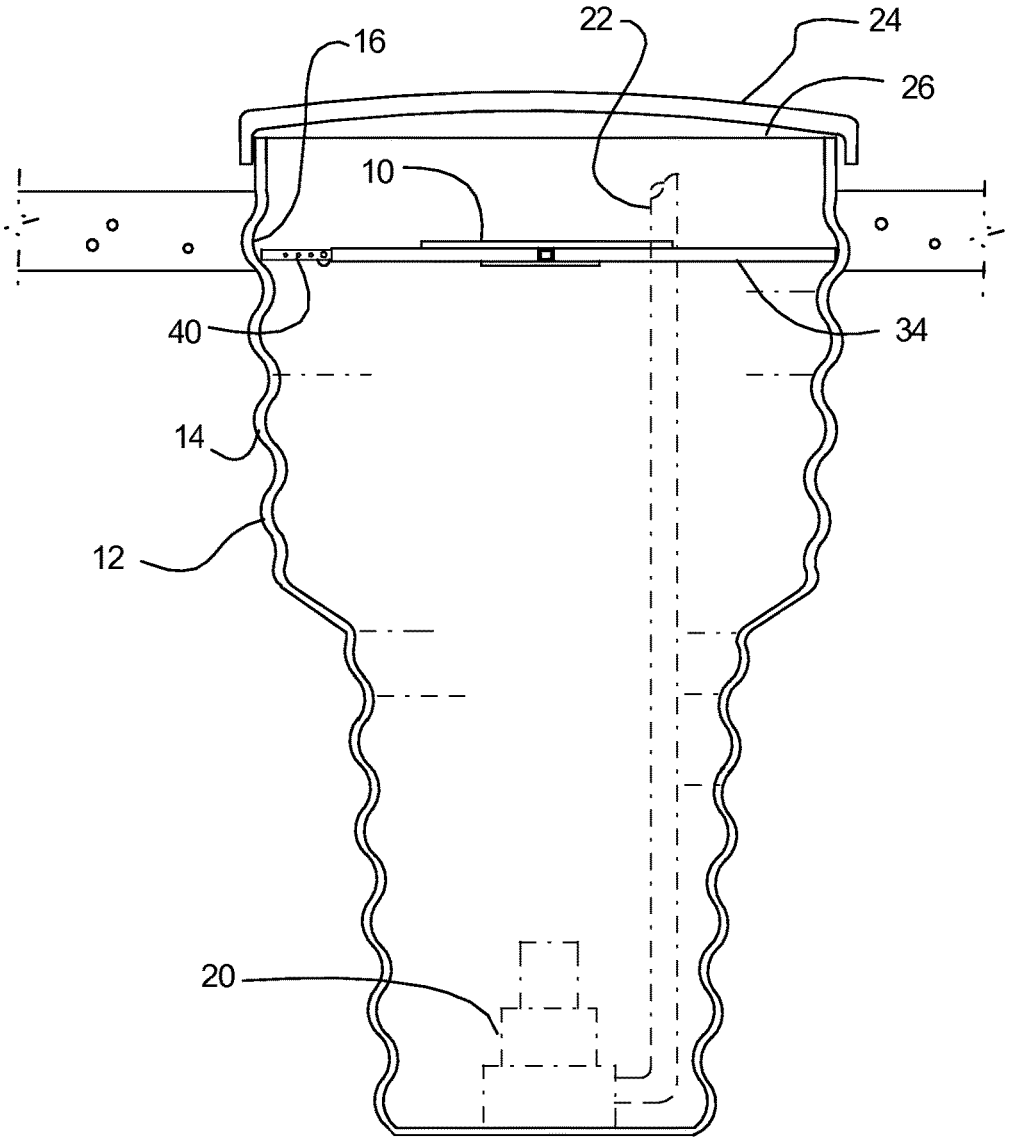
FIG. 1 shows a sump pump pit with corrugated walls and cover, as well as an outline of the sump pump and systems, such as discharge plumbing and electrical connections.

Turning now to FIG. 1 where a safety barrier 10 has been illustrated within a sump pit 12. The sump pit 12 includes corrugations 14 that generally radial at different depths along the sump pit 12. Also illustrated is that at least one of the corrugations 14 will including a continuous recessed surface 16. The illustrated sump pit 12 is show as being generally conical or having concentric tubular sections, each section being of smaller diameter than the previous section. Also, it should be noted that while the disclosed invention has been illustrated in use with a generally cylindrical sump pit 12, it is contemplated that the disclosed invention may also be used with sump pits that have generally square, rectangular or even triangular cross sections. However, it is believed that a cylindrical cross section will be the most efficient in terms of use of material for creating a sump pit.

Also, while it contemplated that the disclosed invention will be especially useful with sump pits that include corrugations 14, it is also contemplated that the disclosed invention may be used with sump pits that include a ledge or groove along a section, the corrugation, ledge, or groove providing a recessed surface 18 that will allow the disclosed invention to be secured at a desired location or depth along the sump pit 12.

Also illustrated in FIG. 1 is that the sump pit 12 is typically used to house a sump pump 20 that cooperates with plumbing 22 that is used to carry out water expelled from the sump pit 12 by the sump pump 20. Additionally, electrical connections and system that control the operation of the sump pump 20 also extend into the sump pit 12, but are not shown in detail in the accompanying drawings.

As discussed above, the sump pit 12 is typically sold with a lid 24 that covers the entrance 26 to the sump pit 12. However, these lids are often weak and easily removed or improperly installed, which in turn defeats one of the primary the purposes of the lid, which is to prevent people from accidentally stepping and falling into the pit. Accordingly, the disclosed safety barrier 10 provides a planar platform 28 at a shallow distance into the sump pit 12. Thus, the disclosed invention acts as a backup to prevent people from falling into the sump pit 12 without restraint.

Figure 2:
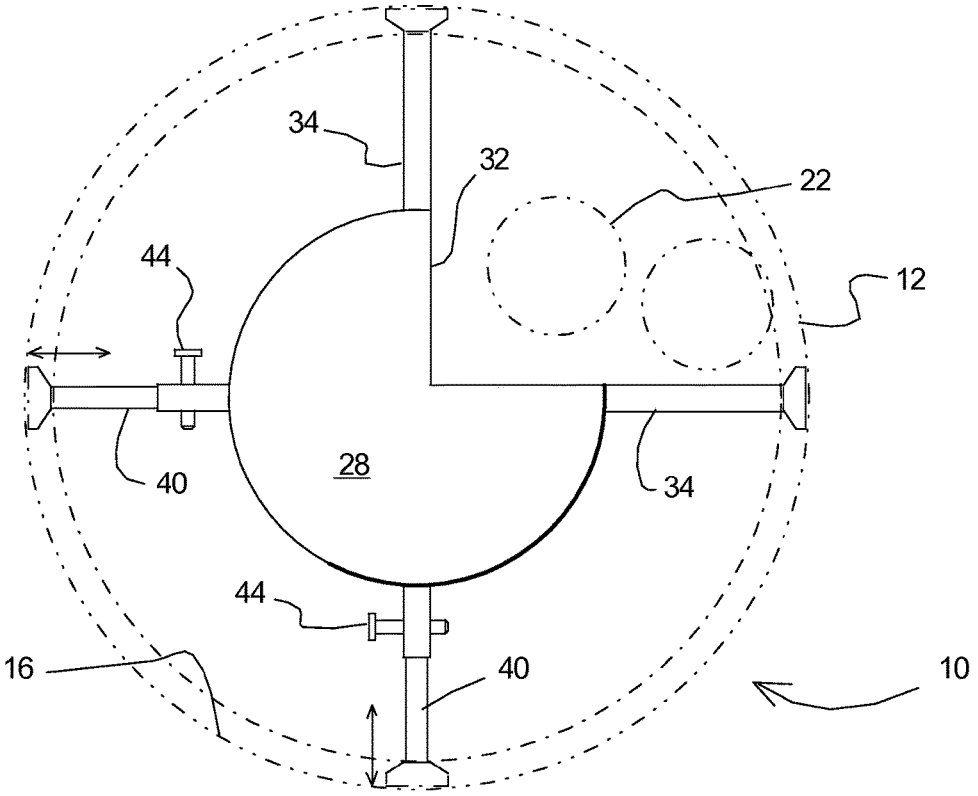
FIG. 2 illustrates the disclosed invention and the cooperation of the legs with the recessed surfaces of the corrugations of the sump pit.
Figure 3:
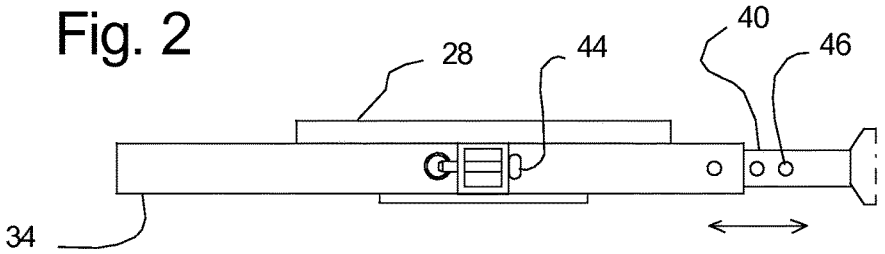
FIG. 3 is a side view of the example shown on FIG. 2, and illustrates the extension of one of the legs to engage the recessed corrugated areas.
Figure 4:
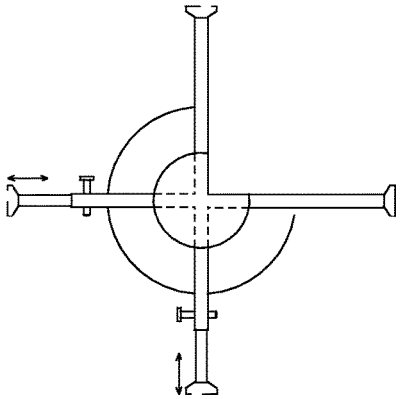
FIG. 4 illustrates the extendibility of the adjacent legs and a concave portion between the, fixed, non-extendible legs. The view also illustrates the adjustability of the two adjacent extendible legs of the preferred embodiment.

Referring to FIG. 2 it will be understood that the platform 28 will have a perimeter 30 that includes a recessed section 32. The recessed section 32 will accommodate the plumbing 22 and other systems that will proceed further into the pit, while allowing the platform 28 to block off most of the remaining cross section of the sump pit 12. FIG. 2 also shows that a preferred example of the invention includes least two fixed legs 34 that project to a fixed distance 36 from the planar platform 28. The fixed legs will be used to engage or bear against the recessed section 16 of the corrugations 14. Preferably, the legs will make contact with the recessed section 16 at spaced apart locations along the recessed section 16. According to a preferred example of the invention, the fixed legs 34 will be at an angle to one another, and will thus diverge from one another as they extend from the platform 28. However, it is contemplated that the fixed legs 34 may be simply spaced apart from one another, so as to contact spaced apart locations along the recessed section 16.

It is preferred that the fixed legs 34 will contact spaced apart locations along the recessed section 16 so that the plumbing and electrical systems used with the sump pump 20 will be accommodated between the fixed legs 34. In order to secure the position of the planar platform 28 in the sump pit 12, at least one, but preferably at least two least two extendible legs 40 will that are attached to the planar platform 28. Like the fixed legs 34, the extendable legs 40 will engage the sump pit 12 at at spaced apart locations along the recessed section 16. Preferably, the extendable legs 40 will diverge from one another as they extend from the planar platform 28, but it is also contemplated that they may be simply spaced apart, in order to provide stability to the support provided to the planar platform 28.

Accordingly, it will be understood that, while it is preferred that the recessed section 32 of the perimeter is located between the two fixed legs 34, the recessed section 32 may alternatively be positioned between the extendable legs 40. However, such an arrangement would increase the possibility that the end user may leave too little room between the recessed section 32 and the sump pit 12. This type of crowding of the systems may then lead to premature failure of the systems due to contact with the planar platform 28. Additionally, it will be understood that it is preferred that the extendible legs be attached the planar platform 28 at an angle of less than 180 degrees to one another To install the disclosed invention within a sump pit 12, the user would simply position fixed legs 34 against the recessed surface 16 along the corrugation in the sump pit 12, and then extend the extendible legs 40 from the planar platform 28 to the opposing section of recessed surface 16 along the corrugation in the sump pit 12, Once the planar platform 28 is secured within the sump pit 12 in this manner, the planar platform 28 will impede deeper access into the sump pit 12, and thus reduce the possibility of injury to anyone falling or stepping into the sump pit 12.

Finally, it is contemplated that the extension of the extendible legs 40 will be accomplished with telescoping leg section 42 that are locked in place by positioning pins 44 that extend through apertures 46 in the extendible legs 40. However, it is contemplated that other methods for extending the extendible legs 40 may also be used. For example, the telescoping sections of the legs may be threaded, and extension may be accomplished by simply turning one section relative to the other. Additionally, a ratchet and pawl mechanism may be incorporated between the two sections, so that the user may simply pull a section out to its desired length.

Figure 5:
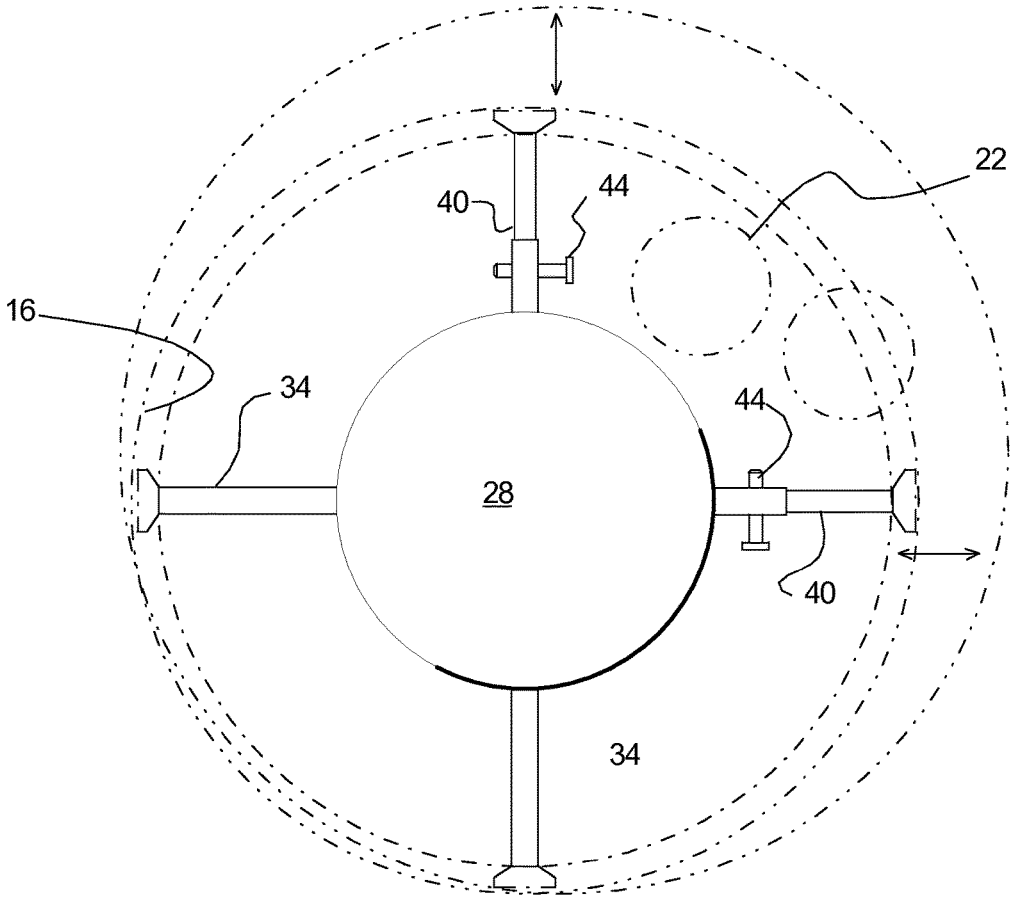
FIG. 5 shows an alternative embodiment, without a cutout for facilitating the passage of plumbing and electrical systems.
Figure 6:
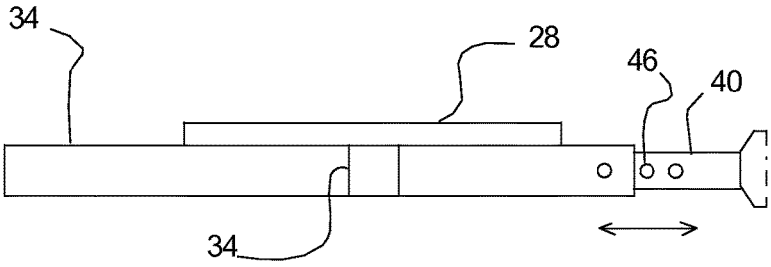

FIGS. 5 and 6 show an alternative embodiment where the platform 28 is relatively small, and thus obviating the need of a recessed area. However, the reduced size of the platform 28 results in reducing the effectiveness of the invention.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A safety barrier for a sump pit, the sump pit including corrugations, at least one of the corrugations including a continuous recessed surface, the safety barrier comprising:

a planar platform having a perimeter with a concave recessed section that extends into the plane of the planar platform in a co-planar manner relative to the plane of the planar platform;

at least one fixed leg that projects to a fixed distance from the planar platform, the at least one fixed leg being positioned next to the recessed section, and two coplanar extendible legs that are attached to the planar platform, each of the at least one fixed leg and two coplanar extendible legs being at an angle of less than 180 degrees to one another, the two coplanar extendable legs extending away from the planar platform along a direction that is generally parallel to the platform and away from the recessed section, the two coplanar extendible legs extending next to and along the recessed section;

said recessed section of the planar platform being generally V-shaped and is bounded by edges that extend next to each of at least one fixed leg, so that the extendable legs protrude away from the planar platform in a manner that is generally parallel to the edges of the recessed section;

and the two coplanar extendible legs being adapted for extending from the planar platform to the recessed surface of the sump pit, so that positioning the at least one fixed leg within one the recessed surface of one of the corrugations allows the user to extend the two coplanar extendible legs away from the planar platform until the two coplanar extendible legs contact the continuous recessed surface to support the planar platform against the recessed in the sump pit and vary the position of the recessed section of the perimeter.

2. A safety barrier for a sump pit, the sump pit including corrugations, at least one of the corrugations including a continuous recessed surfaces, the safety barrier comprising:

a planar platform having a perimeter with a recessed section, the recessed section of the planar platform being a generally V-shaped extending through the planar platform, and bounded by a pair of edges;

at least two coplanar fixed legs that project from the planar platform, and at least two coplanar extendible legs that are attached to the planar platform and are coplanar with the two coplanar fixed legs, the two coplanar extendible legs extending next to the edges of the recessed section and being adapted for extending away from the least two coplanar fixed legs and engage the recessed section of the corrugations of the sump pit, the at least two coplanar fixed legs being at an angle of less than 180 degrees to one another and extending away from the planar platform along a direction that is generally parallel to the platform, the planar platform being adapted for positioning the planar platform against the recessed area in the sump pit and extending the at least two coplanar extendible legs from the planar platform to the recessed surface of the sump pit, so that positioning one of the at least two coplanar fixed legs within one the recessed surface of one of the corrugations and extending the at least two coplanar extendible legs away from the planar platform until the at least two coplanar extendible legs contact the continuous recessed surface and supports the planar platform against the recessed in the sump pit, so that the platform impedes access into the sump pit.

* * * * *